US005260644A

United States Patent [19]

Curtis

[11] Patent Number: 5,260,644

[45] Date of Patent: Nov. 9, 1993

[54] SELF-ADJUSTING SHUNT REGULATOR AND METHOD

[75] Inventor: Dale V. Curtis, Tempe, Ariz.

[73] Assignee: Motorola, Inc., Schaumburg, Ill.

[21] Appl. No.: 889,916

[22] Filed: May 29, 1992

[51] Int. Cl.[5] ..... G05F 1/613

[52] U.S. Cl. ..... 323/226; 323/223

[58] Field of Search ..... 323/223, 226, 220

[56] References Cited

U.S. PATENT DOCUMENTS 4,366,432 12/1982 Noro ..... 323/226

FOREIGN PATENT DOCUMENTS

WO87/03753 6/1987 PCT Int'l Appl. .
239392 8/1969 U.S.S.R. ..... 323/226
813384 3/1981 U.S.S.R. ..... 323/220

OTHER PUBLICATIONS

Drawings from a Book entitled Electronic Circuits Manual, by John Markus, McGraw-Hill Book Company, Copyright 1971, pp. 651,655,666, and 669.

An article entitled "Voltage Regulators", from the book Silicon Power Transistor Handbook, published by Westinghouse Electric Corporation, Copyright 1967, pp. 6-17 through 6-22.

*Primary Examiner*—William H. Beha, Jr.
*Attorney, Agent, or Firm*—Robert M. Handy

[57] ABSTRACT

A shunt regulator for isolating a power supply and load is described which automatically adjusts the quiescent current though the shunt, and therefore its available dynamic range, in proportion to the load current fluctuations. A signal proportional to the load current fluctuations is differentiated, detected, integrated and fed back to control the bias on the shunt. When large load current fluctuations occur, the operating point of the shunt is shifted to higher current values so as to provide a large dynamic regulation range. When load current fluctuations are small or zero, the operating point of the shunt is moved toward cut-off, thereby reducing the dynamic range of the shunt and conserving power. This substantially reduces the power dissipation in the regulator because the shunt need not be constantly biased to handle the largest anticipated load current fluctuation.

20 Claims, 3 Drawing Sheets

SELF-ADJUSTING SHUNT REGULATOR AND METHOD

FIELD OF THE INVENTION

The present invention concerns generally, an improved means and method for isolating a power supply and a load.

BACKGROUND OF THE INVENTION

Regulators are widely used to isolate a power supply and load. They are generally of two types: (1) regulators intended to insure constant load voltage or current independent of power supply fluctuations, or (2) regulators intended to insure constant power supply voltage or current independent of load variations. Some equipment may employ both types of regulators.

The second type of regulator is particularly important where it is desired to prevent multiple loads sharing a common power supply from interfering with each other, as for example, fluctuations in one load being coupled back to the power supply where they may affect the voltage or current being supplied to another load.

Another application in which the second type of regulator is important is in connection with equipment where a high degree of data security is desired. For example, if fluctuations in the data being processed by the load cause fluctuations in the power supply current or voltage, these power supply fluctuations may be susceptible to external detection and therefore compromise data security. For instance, if the load is a communication processor handling digital or analog data, where the data manipulation by the processor causes the load impedance seen by the power supply to fluctuate in a manner correlated with the data, then the fluctuating current drawn from the power supply and/or fluctuating power supply voltage can contain information correlated with the data. By monitoring the supply lines from the power supply to the load, or even just the input lines from the mains to the power supply, the digital or analog information being handled by the load may be detectable. A further risk in this situation is that the Power supply fluctuations may radiate and be detectable from a considerable distance from the apparatus without any direct connection thereto.

Where a high degree of data security is important, it is desirable that the power supply run at substantially constant voltage and/or constant current (or both), despite fluctuations of load impedance and corresponding load current and/or voltage fluctuations. It is not necessary that all power supply fluctuations be suppressed, but only those fluctuations that would correlate with the data. These data related fluctuations in the load current or voltage can be viewed as an AC noise created by the load which it is desirable to prevent being coupled to the power supply. Slow (near DC) fluctuations in the load current or voltage can generally be tolerated since even though coupled to the power supply, they contain little or no significant information about the data being processed by the load. When the AC load fluctuations are suppressed or compensated, monitoring the power supply does not give information on the data being processed by the load.

While many regulator circuits are known in the art, they suffer from a number of limitations, as for example, excessive power consumption, especially under stand-by conditions. Further, while it is known to provide isolation between power supply and load by using LC filters to remove or block out high frequency load induced transients, this is not practical in many applications when the frequency of the transients is such that the required inductors (L) and capacitors (C) are too large and too heavy.

Thus, an ongoing need continues to exist for an improved means and method for regulators, especially AC regulators which isolate the power supply from the load with a high degree of effectiveness. It is further desirable that the regulator consume as little power as possible when not regulating, e.g., during stand-by, since available power is at a premium in many applications, as for example, in hand-held and battery operated equipment. It is still further desirable that the isolation be accomplished over a broad frequency range without use of bulky filter capacitors and inductors.

SUMMARY OF THE INVENTION

The present invention advantageously provides an improved regulator and method for reducing AC coupling between a load and its power supply, wherein the regulator has an input and an output, comprising, means for sensing changes in regulating or regulated current and providing a control signal related to changes therein, a variable current path coupled to the input for diverting in response to a control signal varying amounts of input current about a quiescent diverted current level into a shunt path, the variations in output current being compensated by variations in the current diverted through the shunt path, amplifier means for receiving the signal from the current sensing means and delivering an amplified and inverted form thereof as a control signal to the variable current path to compensate the load varying output current, detection means for determining the maximum excursions of the compensating current or maximum excursions of the load current, and means for changing the quiescent operating level of the variable current path in response to the detected maximum excursions, so that as the maximum excursions decrease the quiescent compensating current level declines and as the maximum excursions increase, the quiescent compensating current increases.

DETAILED DESCRIPTION OF THE PREFERRED EMBODIMENT

Figure 1:
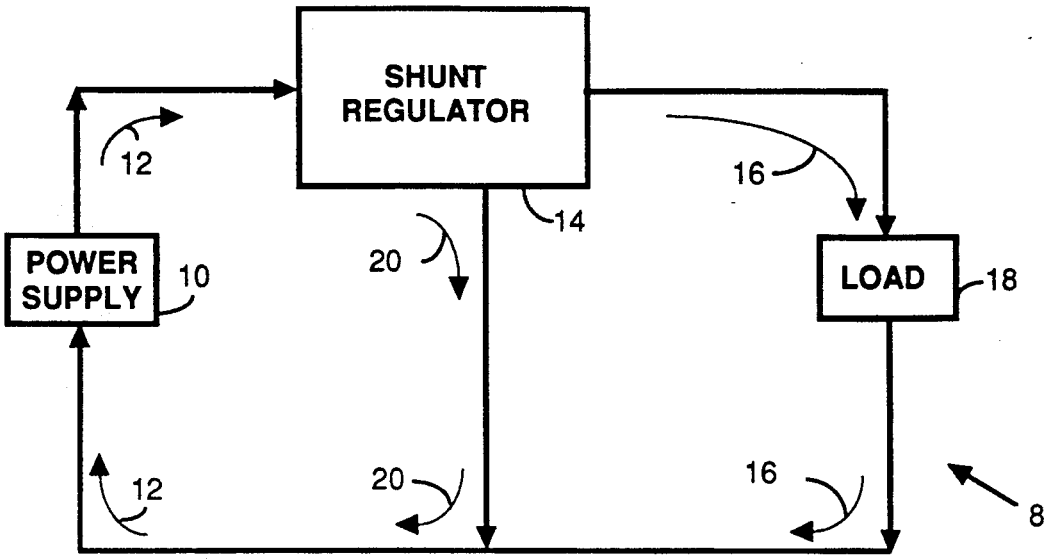
FIG. 1 PRIOR ART
FIG. 1 is a simplified block diagram of an isolating shunt regulator according to the prior art.

FIG. 1 illustrates conventional prior art shunt regulating circuit 8 comprising power supply 10 which provides current 12 to shunt regulator 14 and load 18. Current 12 from power supply 10 is split by shunt regulator 14 into two portions; current portion 16 which flows through load 18 and current portion 20 which flows in shunt across load 18 back to power supply 10, so that $I_{12}=I_{16}+I_{20}$. Shunt regulator 14 detects variations in load current 16 and adjusts shunt current 20 so that $I_{12}$ is substantially constant. When load current 16 increases, shunt current 20 decreases substantially in equal measure, and vice-versa, so that the sum of the two currents $I_{16}+I_{20}$ remains substantially constant. Circuits for providing shunt regulation are well known in the art. While circuit 8 shows a constant current regulator, constant voltage regulators are also known.

In the classical shunt regulator, DC as well as AC load current variations may be compensated. What is of interest in connection with the present invention is the AC load current variations, since it is these variations that may contain information about the data being processed by the load. The present invention is concerned with isolating power supply 10 from the AC component of the load current fluctuations. That there may also be very slow, i.e., quasi DC, load current fluctuations is not of significant concern since they generally contain no important information about the data being processed by the load and hence their detection via the power supply does not present significant risk. Thus, in the context of the present invention, the relation $I_{12}=I_{16}+I_{20}=$ Constant is intended, unless otherwise noted, to refer to AC signals.

One of the limitations of prior art shunt regulators such as is illustrated in FIG. 1, is that shunt current 20 must be at least as great as the largest anticipated fluctuation in load current 16. For example, if load current $I_{16}$ will from time to time fluctuate by an amount $\Delta_{max}I_{16}$, then shunt current $I_{20}$ must at least equal $\Delta_{max}I_{16}$, i.e., $I_{20}\geqq\Delta_{max}I_{16}$. This results in substantial power dissipation in shunt regulator 14. It is often the case, that most of the time, load current fluctuations are small, e.g., 0 to 15%, and only occasionally reach large values such as for example ±50%. With the prior art arrangement, $I_{20}$ must be set to handle the largest anticipated fluctuation, with the result that most of the time the energy used to supply this large shunt current is entirely wasted.

A further difficulty noted earlier is that, while high frequency fluctuations, e.g., greater than about $2\times10^5$ Hz, can generally be filtered out, lower frequency fluctuations and particularly fluctuations below about $104-10^5$ Hz are much more difficult to filter out with components of practical size and weight for many applications, especially in portable, hand-held units.

Figure 2:
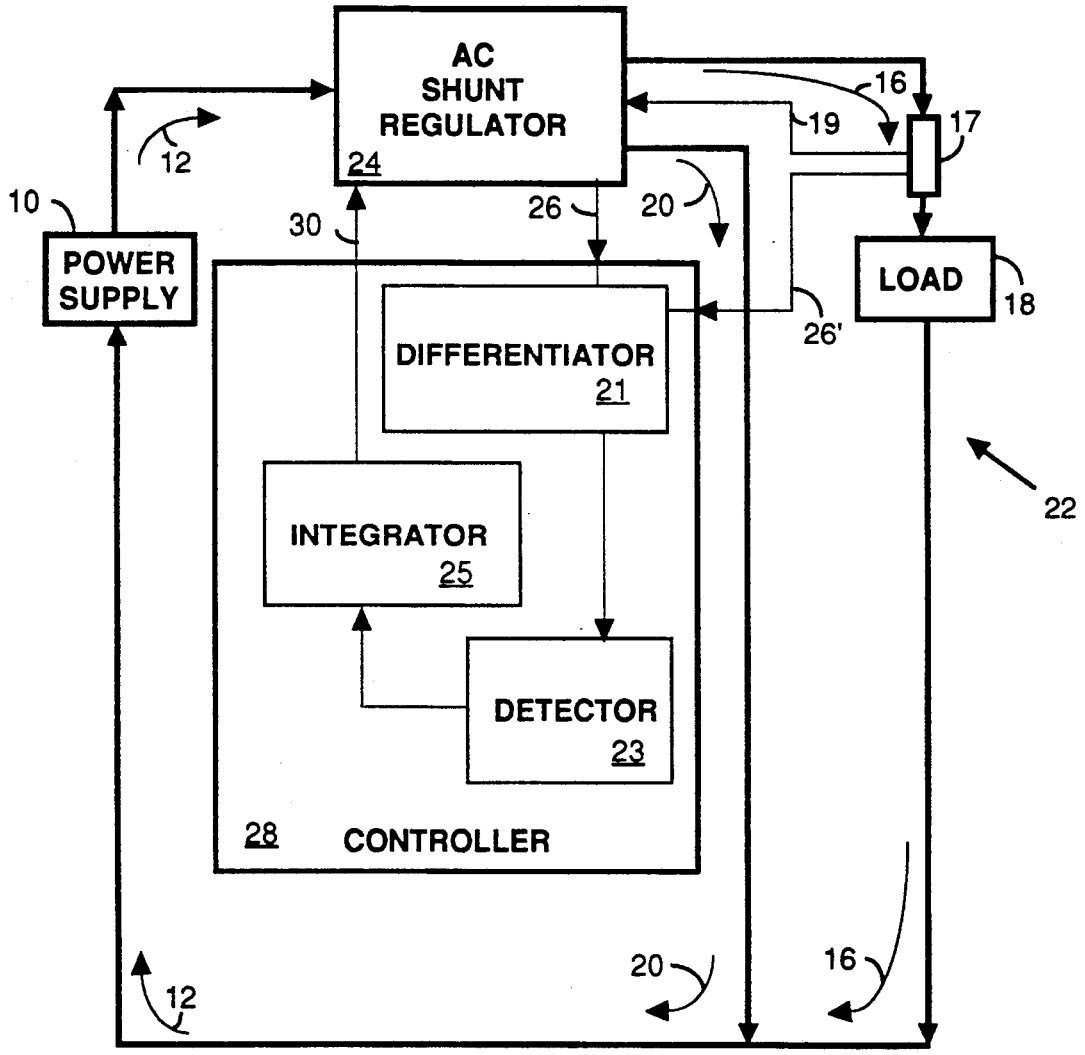
FIG. 2 is a simplified block diagram of an isolating self-adjusting AC shunt regulator according to the present invention.

The present invention avoids these and other deficiencies of the prior art and provides substantial isolation without the deleterious wastage of power or use of bulky filter components, over a wide range of AC frequencies. FIG. 2 shows a simplified block diagram of improved self-adjusting shunt regulator circuit 22 according to the present invention. Power supply 10, load 18 and currents 12, 16, 20 are analogous to those shown in FIG. 1. Shunt regulator 24 is analogous to shunt regulator 14 in that it provides shunt regulation, but has an output connection 26 to controller 28 and input connection 30 from controller 28 so that the amount of shunt regulation being provided and the quiescent or average operating level of the shunt is controllable in a particular fashion explained below. Examples of the internal construction of shunt regulator 24 and controller 28 are shown in more detail in FIGS. 3–4.

Regulator 24 provides an output connection 26 which provides a signal proportional to either shunt current 20 and/or load current 16. Sensor 17 in series with load 18 may be used to provide a signal proportional to load current 16 to regulator 24 via connection 19 and/or to controller 28 via connection 26'. For convenience of explanation, it is assumed in the description that follows, that connection 26 provides a signal proportional to shunt current 20 to controller 28, but this is merely for convenience of explanation. The fluctuations in shunt current 20 and load current 16 are related by the equation $I_{20}+I_{16}=C_o$, where $C_o$ is a constant. Considered as AC signals, they are of equal magnitude but opposite phase. When $I_{20}$ goes up, $I_{16}$ goes down and vice-versa. Hence one is the mirror of the other. Those of skill in the art will appreciate based on the description herein that either can be used for the purposes described, and the use of one for purposes of illustration and explanation is not intended to exclude the other.

Controller 28 receives and differentiates the signal appearing at connection 26 (or 26') to determine the fluctuations in shunt current 20 (and therefore load current 16). This is conveniently accomplished in differentiator 21.

It is desirable that controller 28 determine the maximum fluctuation, i.e., $\Delta_{max}I_{20}$ (or $\Delta_{max}I_{16}$). This is readily accomplished by including a peak detector in controller 28 that detects the maximal value of $\Delta I_{20}$ (or $\Delta I_{16}$). This is conveniently accomplished by the combination of detector 23 and integrator 25. It is further desirable that the peak detector have predetermined and unequal rise and decay time constants, such that it responds rapidly to increases in $\Delta I_{20}$ and relatively slowly to decreases in $\Delta I_{20}$, and in the absence of fluctuations has an output appearing on connection 30 which decays to a predetermined quiescent value.

The peak detected output of regulator 28 is desirably fed back to regulator 24 by connection 30 with such polarity that an increase in $\Delta_{max}I_{20}$ (or in $\Delta_{max}I_{16}$) causes the average value of shunt current 20, i.e., $I_{20}$(Avg.), to increase proportionately. Conversely, when $\Delta_{max}I_{20}$ (or $\Delta_{max}I_{16}$) decreases, the signal on connection 30 causes $I_{20}$(Avg) to decrease. When $\Delta_{max}I_{20}$ (or $\Delta_{max}I_{16}$) goes to zero, $I_{20}$(Avg) assumes a predetermined quiescent value, that is, the minimum predetermined shunt current value $I_{20}$(Min). Thus, the effect of controller 28 is to change the value of $C_o$ in the equation $I_{16}+I_{20}=C_o$ depending upon the magnitude of $\Delta I_{20}$ (or $\Delta I_{16}$), preferably $\Delta_{max}I_{20}$ (or $\Delta_{max}$16). $I_{20}$(Min) is generally selected to be large enough that it can compensate the fastest transient change in $I_{16}$ for a time sufficient for controller to respond and increase $I_{20}$(Avg).

Figure 3:
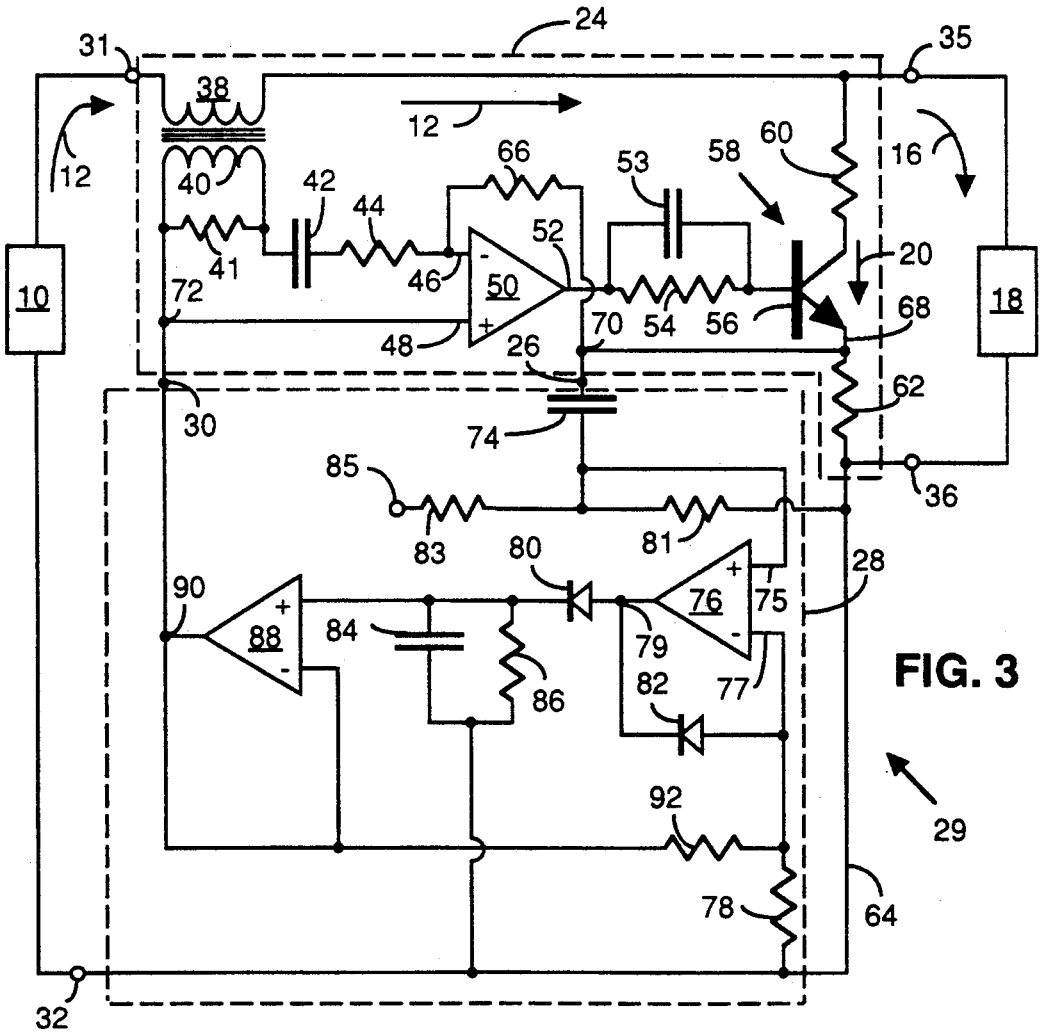
FIG. 3 is a simplified schematic circuit diagram of an isolating, self-adjusting AC shunt regulator according to the present invention.

FIG. 3 shows simplified circuit 29 suitable for implementing regulator 24 and controller 28 according to a first embodiment of the present invention. Circuit 29 has input ports 31, 32 leading to power supply 10 and output ports 35, 36 leading to load 18. The details of regulator 24 and controller 28 of FIG. 2 are shown within the dashed outlines of FIG. 3 identified by the same references numerals.

Regulator 24 conveniently comprises current fluctuation sensor 38, e.g., a series transformer through which current 12 is coupled between I/O ports 31, 35. Any form of current change sensor can be used, but a transformer is convenient because of its relatively small loss. Load current sensor 17 may be of the same or different type. The function of shunt regulator 24 is to vary shunt current 20 to compensate for changes in load current 16 so that the fluctuations of supply current 12 are only a small fraction of the fluctuations of load current 16.

Regulator 24 of FIG. 3 illustrates an arrangement in which incremental in supply current 12 are detected by sensor 38 and shunt current 20 adjusted to minimize such detected changes, e.g., a feedback controller with high loop gain. While this is preferred, those of skill in the art will understand based on the description herein, that fluctuations of load current 16 can be measured directly, as for example using sensor 17, coupled back to regulator 24 via line 19, inverted and amplified so as to adjust shunt current 20 to fluctuate in equal amount and opposite phase to the fluctuations in load current 16, thereby reducing the fluctuations in supply current 12 to a small fraction of the fluctuations in load current 16. Thus, either arrangement is useful. For purposes of explanation, and not intended to be limiting, the operation of regulator 22 is described for the arrangement using sensor 38 measuring fluctuations of supply current 12.

Supply current fluctuations appearing on output winding 40 of sensor 38 appear across resistor 41 and are conveniently coupled via capacitor 42 and resistor 44 to inverting input 46 and non-inverting input 48 of op-amp 50. Since a transformer is used for sensor 38 in the circuit of FIG. 3 and AC coupling capacitor 42 included, this implementation of regulator 24 does not provide DC regulation, but only AC regulation. If DC regulation is also desired, then a resistance may be used for sensor 38 and capacitor 42 omitted. It is desirable that op-amp 50 have high gain.

The amplified fluctuation in current 12 appearing on output 52 of op-amp 50 is conveniently coupled via resistor 54 and capacitor 53 to input 56 (e.g., the base) of shunt 58 (e.g., a bipolar power transistor or Darlington or other variable shunt impedance). Capacitor 53 is conveniently included to shape the high frequency response of the shunt compensation circuit relative, but this is not essential. Resistors 60, 62 are conveniently coupled to the power input/output (I/O) terminals of shunt 58 (e.g., the collector and emitter terminals) and to output ports 35, 36 and power supply return line 64. Feedback resistor 66 is conveniently provided between (emitter) connection 68 and inverting op-amp connection 46. Connection 26 from regulator 24 to controller 28 is conveniently coupled to node 70 and connection 30 from controller 28 is conveniently coupled to node 72 of regulator 24.

The Polarities of sensor 38, op-amp 50 and shunt 58 are arranged such that an infinitesimal change in load current 16 producing an infinitesimal change in supply current 12 through sensor 38, thereby providing a signal on output 40 of sensor 38 which when passed through amplifier 50, causes the bias on shunt 58 to shift in a direction so as to cause current 20 through shunt 58 to change by an amount substantially equal and opposite to the change in current 16. The degree to which the changes in current 20 mirror (and therefore compensate) changes in current 16, depends upon the sensitivity of sensor 38, the gain through amplifier 50 and the transconductance of shunt 58. The gain of op-amp 50 determines how closely $I_{20}$ will track $I_{16}$ and op-amps with gains of the order of about 50 db or more are desirable, generally the higher the better consistent with stability. The gain bandwidth product (GBW) of op-amp 50 is also important. Gain Bandwidth products $\geqq 1$ MegaHz are desirable with $\geqq 10$ MegaHz preferred. The higher the frequency response, the faster the load transients that can be compensated by shunt 58 of regulator 24. The slowest load transients compensated by regulator 24 are determined by the low frequency cut-off of sensor 38 and capacitor 42. The combination of current sensor 38, amplifier 50 and shunt transistor 58 comprise a self-correcting feedback loop which provides for automatic shunt regulation.

The signal appearing at node 70 and connection 26 is proportional to shunt current 20, i.e., proportional to $I_{20}$. Capacitor 74 coupled to connection 26, blocks the DC value of $I_{20}$ so that only $\Delta I_{20}$ is passed to non-inverting input 75 of op-amp 76. Inverting input 77 of op-amp 76 is coupled via resistor 78 to power supply return line 64. Output 79 of op-amp 76 is coupled to diodes 80, 82 which convert the amplified fluctuating signal derived from $\Delta I_{20}$ via op-amp 76 to a unidirectional signal which is integrated on capacitor 84. Resistor 86 provides a controlled decay time constant for integrating capacitor 84. The combination of diodes 80, 82 and capacitor 84 form a peak detector. Buffer amplifier 88 is conveniently provided across integrating capacitor 84. The amplified peak values of fluctuations $\Delta I_{20}$, i.e., $\Delta_{max}I_{20}$, appearing at output 90 of amplifier 88 are coupled to connection 30 between controller 28 and regulator 24. Resistors 78 and 92 conveniently set the gain of op-amp 76 and resistors 83, 81 set the zero signal output level, and together determine by means of shunt 58 the quiescent can compensate the fastest transient change in $I_{16}$ for a value of $I_{20}$ when $\Delta I_{20}$ is zero, that is $I_{20}$(Min).

The signal from controller 28 at connection 30 sets the value of $I_{20}$(Avg) by setting the value of bias on shunt 58. Assume that a step function change occurs in $I_{20}$ by virtue of the normal operation of regulator 24 responding to a corresponding change in $I_{16}$, then a large value of $I_{20}$ is coupled through capacitor 74 and amplifier 76, rectified by diodes 80, 82 and stored on capacitor 84. The rise time of the voltage on capacitor 84 is substantially determined by the size of capacitors 74, 84, the circuit resistances and the slew rate of amplifier 75 and the, resistance of diode 80. By appropriately selecting resistor 62, capacitors 74, 84, diodes 80, 82 and amplifier 76, the rise-time response to current changes $\Delta I_{20}$ can be set at any reasonably desired value. The peak detecting properties of the combination of diodes 80, 82 and capacitor 84, stores the peak value of the current change $\Delta_{max}I_{20}$, and causes a corresponding shift in $I_{20}$(Avg) via amplifier 88, connection 30, node 72 and amplifier 50. A wideband amplifier may be used for op-amp so as to provide rapid response to sudden changes in the load and shunt current fluctuations. Even though the change in $I_{20}$(Avg) produced thereby may be rapid, and may appear as a transient on $I_{12}$, it does not reveal significant information on the data being processed by the load because of the integration provided by capacitor 84.

Once a new value of $I_{20}$(Avg) has been set in response to a new $\Delta_{max}I_{20}$, it will remain at the value determined by the new $\Delta_{max}I_{20}$ until the voltage on capacitor 84 decays by virtue of discharge resistor 86. Since the value of resistor 84 has little effect on the rise time response to $\Delta I_{20}$, the rise and fall time of changes in $I_{20}$(Avg) can be substantially independently selected and can be different. This is a particular feature of controller 28.

It is desirable that the decay time constant for $I_{20}$(Avg) be about 0.1 millisec to 10 seconds, with about 1 millisec to 3 seconds being convenient and about 10 millisec to 1 second being preferred. This is generally long enough to smooth over all data transients so that the variations appearing in $I_{12}$ as a result of changes in $I_{20}$(Avg) contain no useful information. However, the particular choice of decay times (and rise times) will depend upon the particular application, which persons of skill in the art will understand how to determine based on the teachings herein.

It is also desirable that the rise times be about $10^{-2}$ to $10^{-6}$ of the decay time, so that the self-adjustment can follow fast changes in the AC fluctuations being generated by load changes. The difference in rise and decay times insures that regulator 24 remains biased at the new value of $I_{20}$(Avg) established by the latest $\Delta I_{max}I_{20}$ for a time substantially longer than the rise time of the load transient itself. This is based on the recognition that, for small fluctuations, the probability that a given load fluctuation will be shortly followed by another similar or larger load fluctuation is greater than the probability that the opposite will occur.

As $\Delta I_{20}$ declines, $I_{20}$(Avg) declines according to the rate determined by capacitor 84 and resistor 86. If only small load transients are encountered, controller 28 automatically adjusts the bias on shunt 58 to provide small values of $I_{20}$(Avg). If $\Delta I_{20}$ becomes substantially zero, then the output of controller 28 drives the bias on shunt 58 such that $I_{20}$(Avg) assumes a comparatively small value $I_{20}$(Min), predetermined by the combination of resistors 78, 92 and 83, 81, in cooperation with the other components of controller 28 and regulator 24. Terminal 85 connects to any convenient reference voltage useful for setting the amplifier bias, and may be conveniently tied to terminal 31 or 35. When operation of controller 28 is based on fluctuations in $I_{20}$, it is desirable that $I_{20}$(Min) not be set to zero, but this is not precluded. If is desired to have $I_{20}$(Min) $=0$, then the circuit should be re-arranged, as those of skill in the art will understand how to do, to use input 26' from sensor 17, taking into account that the phase of input 26' is inverted compared to input 26.

Thus, controller 28 causes the average shunt current $I_{20}$(Avg) to automatically adjust to have the smallest predetermined value consistent with the level of load transients which the system is then experiencing. This substantially reduces the power consumption, since it is no longer necessary to fix the average shunt current at a level corresponding to the largest anticipated transients. The circuit automatically self-adjusts to handle such large transients whenever they occur and automatically turns down the bias and reduces the average shunt current during periods of little or no load fluctuations. The changes in power supply current 12 that occur as a result of this automatic action only indicate that the circuit is self-adjusting, but do not otherwise provide information on the detailed nature of the load data. This satisfies the requirement that monitoring of the power supply conditions does not compromise data security.

The above-described circuit permits the normal (little or no load current fluctuations) bias setting of shunt 58 to be kept at a minimum level until load current fluctuations begin to occur, at which time the bias point of shunt 58 is automatically reset to handle larger and larger current fluctuation signals. Particular features of regulator 29 are that it compensates for a wide range of load impedance variations, it saves substantial power by not requiring that shunt transistor (or other variable shunt impedance) 58 be constantly biased for the worst case conditions, it responds quickly and dynamically to load current fluctuations, and it provides load fluctuation compensation over a wide frequency range without use of bulky filter components. The automatic regulator increases the shunt bias to provide greater dynamic range when that is needed and causes it to decay to smaller values when less shunt current is needed. The rise and fall times of the bias can be independently set. For example, rapid rise (bias to higher quiescent currents) time, slow decay (bias toward smaller quiescent currents) time. A further advantage is that the operation is totally automatic.

Figure 4:
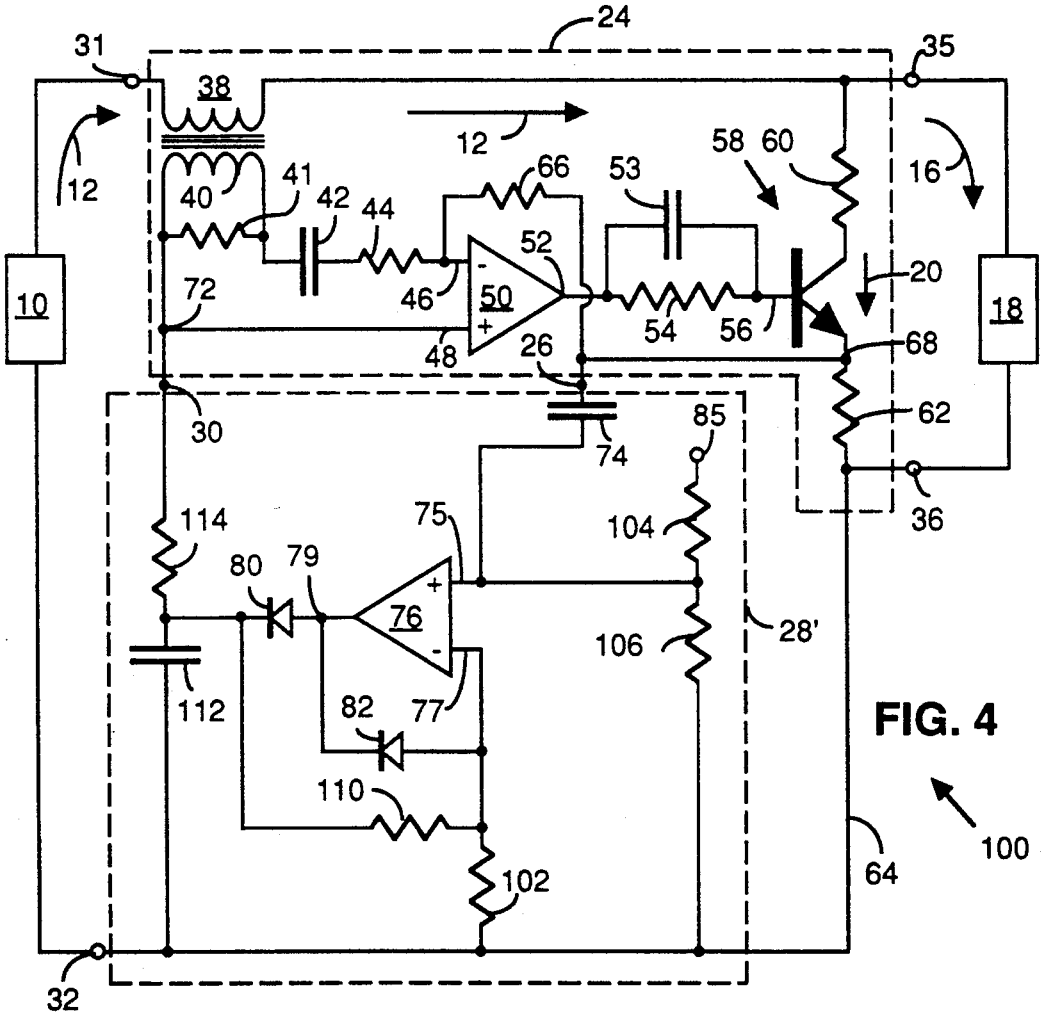
FIG. 4 is a simplified schematic circuit diagram of an isolating, self-adjusting AC shunt regulator according to a further embodiment of the present invention.

FIG. 4 shows an alternative embodiment of automatic regulator 100 comprising regulator 24 and controller 28' analogous to controller 28. The operation of regular 24 is substantially the same as was described in connection with FIG. 3. Output 26 from regulator 24 is fed through capacitor 74 to non-inverting input 75 of op-amp 76. Inverting input 77 of op-amp 76 is tied to reference line 64 through resistor 102. Output 79 of op-amp 76 is coupled to diodes 80, 82, feedback resistor 110 and integrating capacitor 112. Integrating capacitor 112 is coupled through resistor 114 to connection 30 between controller 28' and regulator 24 and node 72 of regulator 24.

Circuit 100 differs from circuit 29 in the implementation of controller 28' in that buffer amplifier 88 is avoided and the connections to and from op-amps 50 and 76 are rearranged to take into account this difference while still providing the differentiation, detection, integration and feedback operations described earlier. Controller 28' automatically adjusts the quiescent operating level of shunt 58 so as to provide small quiescent current $I_{20}$(Avg) when $\Delta_{max}I_{20}$ is small and large $I_{20}$(Avg) when $\Delta_{max}I_{20}$ is large. With the arrangement of circuit 100, the decay time constant of integrating capacitor 112 is substantially controlled by the combination of resistors 102 and 110 (and the value of capacitor 112) and the minimum value of $I_{20}$, that is $I_{20}$(Min) for $\Delta_{max}I_{20}=0$, is substantially determined by the combination of resistors 104, 106 and the bias voltage on terminal 85. As noted in connection with FIG. 3, terminal 85 may be connected to any convenient bias voltage source and is conveniently connected to terminals 31 or 35.

Circuit 100 has one less op-amp, which saves on parts and board space. The relative merits of circuits 29 and 100 depend upon the particular combination of tradeoffs desired by the user. In terms of providing an automatic self-adjusting shunt bias regulator responsive to the magnitude of the load current fluctuations, both are suitable.

In summary, the circuits of FIGS. 2-4 provide for automatic shifting of the quiescent operating (bias) point of the shunt. A first feedback circuit within regulator 24 automatically adjusts the shunt current to isolate power supply 12 from AC fluctuations of load 18 and vice versa. Controller 28, 28' desirably shifts the current shunt closer to cut-off when only small shunt (or load) current fluctuations are detected, and to larger biases permitting greater shunt regulation dynamic range when larger shunt (or load) current fluctuations are detected. This provides an inherent power conserving capability in addition to the function of isolating the power supply and load so that load data is not compromised by monitoring power supply behavior. The invented unit provides 50 db isolation over a frequency range from about $2\times10^2$ to $5\times10^5$ Hz without use of bulky filter components. The 0 db attenuation bandwidth is about $10^1$ to $4\times10^6$ Hz. This is a highly desirable combination.

The method of the present invention for isolating a power supply from load current fluctuations using a shunt regulator, is summarized as follows: (1) providing a signal proportional to the shunt or load current and differentiating the signal or by passing it through a capacitor or DC separator, so as to obtain the fluctuations of the load or shunt current; (2) determining the peak values of the magnitude of these fluctuations, as for example but not intended to be limiting, by rectifying and integrating the current fluctuation signals using a predetermined time constant; (3) feeding back the peak values to the shunt regulator serving the load, to adjust the shunt current such that an increase in the magnitude of the shunt or load current fluctuations increases the average shunt current, and a decrease in the magnitude of the shunt or load current fluctuations results in a decrease in the shunt current. In a preferred embodiment of the method, the rate of decrease of the average shunt current is pre-determined and different than the rate of increase of the average shunt current, in response to the above-described process.

Based on the foregoing description, it will be apparent to those of skill in the art that the present invention solves the problems and achieves the goals set forth earlier, and has substantial advantages as pointed out herein, namely, increased dynamic range, much lower power consumption, fast response, controllable decay and automatic untended operation, and no need for bulky filter components.

While the present invention has been described in terms of particular materials, structures and steps, these choices are for convenience of explanation and not intended to be limiting and, as those of skill in the art will understand based on the description herein, the present invention applies to other choices of materials, arrangements and process steps, and it is intended to include in the claims that follow, these and other variations as will occur to those of skill in the art based on the present disclosure.

What is claimed is:

1. A regulator for reducing AC coupling between a load and its power supply, said regulator comprising:

a shunt in parallel with the load and coupled to the power supply for diverting in response to a control signal, varying amounts of power supply current up to a predetermined diverted current level through said shunt;

a sensor for sensing changes in shunt or load current and providing a first signal related to changes therein;

a peak detector coupled to the sensor and the shunt for detecting peaks of the first signal and modifying the control signal so that the predetermined diverted current level changes in response to changes in the peaks of the first signal.

2. A regulator for reducing AC coupling between a load and its power supply, said regulator comprising:

a shunt in parallel with the load and coupled to the power supply for diverting in response to a control signal, varying amounts of power supply current up to a predetermined diverted current level through said shunt;

means for sensing changes in shunt or load current and providing a first signal related to changes therein;

means for determining a second signal proportional to the magnitude of the first signal;

means for determining a third signal proportional to peak values of the second signal, means for feeding the third signal back to the shunt to provide the control signal so that the control signal increases the predetermined diverted current level when the third signal increases and decreases the predetermined diverted current level when the third signal decreases; and wherein the means for sensing changes comprises a resistance in series with the shunt combined with a capacitance through which the first signal related to changes in the shunt current passes.

3. The regulator of claim 2 wherein the shunt comprises a transistor amplifier.

4. The regulator of claim 3 wherein the means for determining a second signal comprises one or more diodes for rectifying the first signal to provide the second signal proportional to the magnitude of the first signal.

5. The regulator of claim 4 wherein the means for determining the second signal further comprises an amplifier for amplifying the first signal before passing it through the one or more diodes to provide the second signal.

6. The regulator of claim 3 wherein the means for determining a third signal comprises an integrating capacitance for integrating the second signal.

7. The regulator of claim 6 further comprising a resistance in parallel with the integrating capacitance to provide a predetermined decay time for the third signal.

8. The regulator of claim 6 wherein the means for determining a third signal further comprises a buffer amplifier having an input coupled to the integrating capacitance and an output coupled to a control terminal of the shunt.

9. The regulator of claim 2 wherein the means for feeding the third signal back to the shunt comprises a current sensor for sensing the power supply current to provide a regulation signal proportional to changes in the power supply current, an amplifier responsive to the regulation signal and providing the control signal output for biasing the shunt to control the diverted current flowing through the shunt so that, within the frequency pass-band of the sensor and amplifier, a fluctuation in power supply current causes an equal and opposite fluctuation of diverted current through the shunt so as to minimize the power supply current fluctuation, wherein the third signal is coupled to an input of the amplifier for modifying the control signal to increase the predetermined diverted current when the third signal increases and decrease the predetermined diverted current level when the third signal decreases.

10. An apparatus for isolating a power supply supplying a load from time varying fluctuations in load current, comprising:

a first circuit comprising a shunt in parallel with the load for diverting a portion of power supply current through the shunt, the amount of diverted current being determined by a control signal provided at a control terminal of the shunt, wherein the diverted current has an adjustable average value and, from time to time a fluctuating value responsive to fluctuations in the load current;

a second circuit comprising a first sensor for sensing fluctuations in power supply current or load current and providing to the shunt a control signal which causes fluctuations of the current diverted through the shunt to be substantially equal and opposite to the fluctuations in the load current so that power supply current fluctuations are a small fraction of load current fluctuations;

a third circuit comprising a second sensor for sensing fluctuations in the shunt current or load current and determining time averaged values of peaks of the fluctuations; and a fourth circuit for feeding back a signal proportional to said time averages values of the peaks of the fluctuations to said control terminal to modify the control signal thereon to change the average value of the diverted current when the time average value of the peaks of the fluctuations changes.

11. The apparatus of claim 10 wherein the first sensor senses fluctuations in the power supply current and an amplifier is provided to amplify such fluctuations and apply them to the control terminal of the shunt with a polarity so as to cause the diverted current to fluctuate in a manner to reduce the supply current fluctuations.

12. An apparatus for isolating a power supply supplying a load from time varying fluctuations in load current, comprising:

a first circuit for diverting a portion of power supply current through a shunt in parallel with the load, the amount of diverted current being determined by a control signal provided at a control terminal of the shunt, wherein the diverted current has an average value and, from time to time a fluctuating value responsive to fluctuations in the load current;

a second circuit comprising a first sensor for sensing fluctuations in power supply current or load current and providing to the shunt a control signal which causes fluctuations of the current diverted through the shunt to be substantially equal and opposite to the fluctuations in the load current so that power supply current fluctuations are a small fraction of load current fluctuations;

a third circuit comprising a second sensor for sensing fluctuations in the shunt current or load current, wherein such fluctuations have magnitudes, and determining therefrom peak values of the magnitudes; and a fourth circuit for feeding back said peak values to said control terminal to modify the control signal thereon to reduce the average value of the diverted current when the peak values decline and increase the average value of the diverted current when the peak values increase;

wherein the first sensor senses fluctuations in the power supply current and an amplifier is provided to amplify such fluctuations and apply them to the control terminal of the shunt with a polarity so as to cause the diverted current to fluctuate in a manner to reduce the supply current fluctuations; and wherein the second sensor senses fluctuations in the diverted current.

13. An apparatus for isolating a power supply supplying a load from time varying fluctuations in load current, comprising:

a first circuit for diverting a portion of power supply current through a shunt in parallel with the load, the amount of diverted current being determined by a control signal provided at a control terminal of the shunt, wherein the diverted current has an average value and, from time to time a fluctuating value responsive to fluctuations in the load current;

a second circuit comprising a first sensor for sensing fluctuations in power supply current or load current and providing to the shunt a control signal which causes fluctuations of the current diverted through the shunt to be substantially equal and opposite to the fluctuations in the load current so that power supply current fluctuations are a small fraction of load current fluctuations;

a third circuit comprising a second sensor for sensing fluctuations in the shunt current or load current, wherein such fluctuations have magnitudes, and determining therefrom peak values of the magnitudes; and a fourth circuit for feeding back said peak values to said control terminal to modify the control signal thereon to reduce the average value of the diverted current when the peak values decline and increase the average value of the diverted current when the peak values increase; and wherein the third circuit comprises a capacitance for blocking DC signals from the second sensor, an amplifier for amplifying fluctuating signals from the second sensor, rectifiers for rectifying the amplified, fluctuating signals, and a capacitance for integrating the rectified amplified values to determine peak values of the magnitude of the signal from the second sensor.

14. The apparatus of claim 10, wherein the second circuit comprises an amplifier whose output comprises the control signal, and wherein the fourth circuit couples the peak values to an input terminal of said amplifier.

15. A method using a shunt current for isolating a power supply from load current fluctuations, wherein the load current and shunt current have quiescent values and fluctuating values, comprising:

providing a first signal proportional to shunt or load current fluctuations;

determining time averaged peak values of the first signal;

feeding back the time averaged peak values to a shunt regulator to adjust the shunt current such that an increase in the peak values of the fluctuations of the shunt or load current increases the quiescent value of the shunt current, and a decrease in the peak values of the fluctuations of the shunt or load current fluctuations decreases the quiescent value of the shunt current.

16. A method for isolating a power supply from load current fluctuations using a shunt current, wherein the load current and shunt current have average values and fluctuating values, comprising:

providing a first signal proportional to shunt or load current fluctuations;

determining the peak values of the magnitude of the first signal;

feeding back the peak values to a shunt regulator to adjust the shunt current such that an increase in the magnitude of the shunt or load current fluctuations increases the average shunt current, and a decrease in the magnitude of the shunt or load current fluctuations decreases the shunt current; and wherein the determining step comprises integrating the magnitude of the first signal in an integrator having a predetermined decay time constant.

17. The method of claim 15 wherein the step of providing a first signal comprises providing a first signal proportional to the shunt current fluctuations.

18. The method of claim 17 wherein the step of providing the first signal comprises obtaining a signal proportional to the shunt current and then removing the DC component thereof to provide the first signal.

19. A method for isolating a power supply from load current fluctuations using a shunt current, wherein the load current and shunt current have average values and fluctuating values, comprising:

providing a first signal proportional to shunt or load current fluctuations;

determining the peak values of the magnitude of the first signal;

feeding back the peak values to a shunt regulator to adjust the shunt current such that an increase in the magnitude of the shunt or load current fluctuations increases the average shunt current, and a decrease in the magnitude of the shunt or load current fluctuations decreases the shunt current; and wherein the determining step comprises rectifying, amplifying and integrating the first signals.

20. A method for isolating a power supply from load current fluctuations using a shunt current, wherein the load current and shunt current have average values and fluctuating values, comprising:

providing a first signal proportional to shunt or load current fluctuations;

determining the peak values of the magnitude of the first signal;

feeding back the peak values to a shunt regulator to adjust the shunt current such that an increase in the magnitude of the shunt or load current fluctuations increases the average shunt current, and a decrease in the magnitude of the shunt or load current fluctuations decreases the shunt current; and further comprising, providing another signal proportional to supply current fluctuations, passing the another signal through an amplifier and feeding the amplified another signal to the shunt regulator so as to minimize supply current fluctuations.

* * * * *